US010676954B1

(12) United States Patent
Oppenheim

(10) Patent No.: US 10,676,954 B1
(45) Date of Patent: Jun. 9, 2020

(54) PORTABLE, STOWABLE OVERHEAD FAN

(71) Applicant: Matthew Oppenheim, Germantown, TN (US)

(72) Inventor: Matthew Oppenheim, Germantown, TN (US)

( * ) Notice: Subject to any disclaimer, the term of this patent is extended or adjusted under 35 U.S.C. 154(b) by 221 days.

(21) Appl. No.: 14/660,939

(22) Filed: Mar. 18, 2015

(51) Int. Cl.

| | |
|---|---|
| ***E04H 15/14*** | (2006.01) |
| ***F04D 19/00*** | (2006.01) |
| ***F04D 25/08*** | (2006.01) |
| ***F04D 29/36*** | (2006.01) |
| ***F04D 29/64*** | (2006.01) |

(52) U.S. Cl.
CPC ..... *E04H 15/14* (2013.01); *F04D 19/002* (2013.01); *F04D 25/088* (2013.01); *F04D 29/36* (2013.01); *F04D 29/646* (2013.01)

(58) Field of Classification Search
CPC ..... E04H 15/14
See application file for complete search history.

(56) References Cited

U.S. PATENT DOCUMENTS 5,108,260 A * 4/1992 Monrose, III ..... F04D 29/364 403/102
6,397,869 B1 * 6/2002 Jennings ..... E04H 15/14 135/120.1
6,742,309 B2 * 6/2004 Stewart ..... A47K 3/286 135/94
6,796,318 B2 * 9/2004 Cohen ..... A45B 3/00 135/16
7,703,466 B1 * 4/2010 Smith ..... E04H 15/10 135/135
9,441,641 B1 * 9/2016 Criswell ..... F04D 29/646

* cited by examiner

*Primary Examiner* — Christopher Verdier
*Assistant Examiner* — Juan G Flores
(74) *Attorney, Agent, or Firm* — William S. Parks

(57) ABSTRACT

A lightweight, portable battery-powered overhead fan including secure attachments for a standard outdoor canopy or other like article is provided. Such a fan further includes blades that are configured with resilient connectors that allow for such blades to tilt or fold for stowing purposes while also securely attaching during actual use in a safe and reliable manner. In this way, each blade attaches to a centrally located portion that rotates during fan operation. The canopy attachments are provided in stowable fashion as well to permit compact transport of the overall fan device to and from an event for which a canopy is erected. Such a device further includes the potential for a fluid reservoir and atomizer component to deliver fluid droplets for increased cooling purposes as well as a light integrated therein or attached thereto. A canopy including such a fan device is also encompassed within this invention.

6 Claims, 6 Drawing Sheets

PORTABLE, STOWABLE OVERHEAD FAN

FIELD OF THE INVENTION

A lightweight, portable overhead fan device including battery powered blades and secure attachments for a standard outdoor canopy or other like article is provided. Such a fan further includes blades that are configured with resilient connectors that allow for such blades to tilt or fold for stowing purposes while also securely attaching during actual use in a safe and reliable manner. In this way, each blade attaches to a centrally located portion that rotates during fan operation. The canopy attachments are provided in stowable fashion as well to permit compact transport of the overall fan device to and from an event for which a canopy is erected. Such a device further includes the potential for a fluid reservoir and atomizer component to deliver fluid droplets for increased cooling purposes as well as a light integrated therein or attached thereto. The fan device and canopy including such a fan device are thus encompassed within this invention.

BACKGROUND OF THE INVENTION

Overhead fans, such as ceiling fans, have been utilized for many years as a means to provide air circulation, both in terms of cooling and heating. Such devices have been designed in myriad configurations for such benefits, as well as for aesthetic purposes. Specific styles and designs have been provided consumers, either through custom or large-scale production and are prevalent within many structures, including homes, office buildings, restaurants, and the like.

The benefits of these devices stretch beyond that of inside structures, certainly, as the need for air circulation in outdoor locations, particularly in hot weather climates and situations, is noticeable, as well. Such fans have been utilized, for instance, on porches and other like dedicated edifices to such effect, albeit in terms of electrical power sources within such buildings. External utilization, particularly in association with portable and erectable structures at locations on demand (and in any selected place on demand) have been far more difficult to achieve.

Erectable canopies, and other like outdoor implements, have been utilized for shade and cooling purposes for myriad numbers of events. For instance, such articles have proven effective as temporary cover for outdoor sporting events, such as for watching under on the sidelines of a game, for tailgating (and like activities), even for providing food and drink supplies to thirsty and hungry attendees. Local fairs, craft shows, and the like, also make use of such canopy structures (large-scale tents, as well) for such cover purposes, particularly to separately provide areas for individuals and/or groups to present their wares. Even with such sun protective cover benefits, however, there still exists the potential for stagnant air, coupled with high humidity, to cause great discomfort to those seeking shade thereunder. In fact, in certain conditions, the lack of air circulation actually may create far worse conditions and discomfort than without such a canopy itself. With the need to provide sufficient protection from the sun and ultraviolet radiation, however, and the ability to provide effective cover for a plurality of individuals with such a canopy structure (instead of, for instance, a single umbrella or parasol), such a cover implement is highly desired. Furthermore, these canopy and/or tent structures allow for the ability for selected individuals to congregate, as well as to provide specific boundaries in terms of selected wares, crafts, and the like, for effective separation from other groups in a crowded multi-canopy or -tent setting. Thus, there lies a significant need to ensure increased comfort for those using such canopies and/or tents, particularly in such high temperature/humidity locations or under such conditions.

Some suggested means to overcome these canopy/tent deficiencies include the utilization of fans on the ground (limiting ingress and egress capability), ground-based water-spray fans (utilizing electrical lines to outlets provided nearby), even some electrically based ceiling fans. Such suggested improvements have fallen well short of the needed levels of versatility and capability, however, for appropriate utilization thereof in such a setting. The prior art overhead fan usages, for instance, require either a significant high weight fan that is cumbersome to carry and lift for placement on the subject canopy frame. Such a heavy device thus exhibit's a high degree of necessary load-bearing by the canopy/tent structure upon implementation thereto, leading to a reduction, for instance, in available space under such a canopy (since, for example, load-bearing poles are typically utilized from canopy to ground within the space thereunder to hold up the frame). Otherwise, the connection capabilities to the canopy structure are limited to external devices that must be attached first to the canopy skeleton, then the entirety of the fan is then attached thereto. Furthermore, with full-size blade structures in place (and not stowed in any fashion), the canopy must first be erected and then the fan lifted and connected thereto. Lastly, some overhead (ceiling) fans of this type still require connection to an electrical line and then to a nearby outlet for actual activation. The cords needed for such a purpose may impede movement of individuals under such a canopy, and, furthermore, such a electrical cord may become detached from such a fan easily during operation. Such potential difficulties are thus to be avoided, if possible, in such situations.

In any event, such prior art devices are limited in their overall capability, most assuredly, leaving the user much to desire in this area. For example, a lightweight structure would certainly limit the strain involved with lifting and placing for the user himself, let alone on the actual canopy structure. The ability to accord sufficient space under the canopy while providing the maximum capability of fan operation and air circulation on demand would thus be attractive in this situation, particularly in such a manner as to reduce the chances of canopy structure failure due to excess weight applied thereto. Additionally, the ability to not only lift a lighter weight device, but also one that may be first attached to the canopy/tent prior to full construction, and then lifting all simultaneously, allows for greater versatility and reliability, certainly, not to mention the ability to avoid any need to utilize a ladder or like implement to reach the apex of such a structure for fan attachment. This capability is not permitted within the prior art fan devices. Furthermore, then, the ability to easily detach from the canopy frame and stow and transport such a device for utilization in a different location (on demand) would also be highly prized in this industry. Again, to date, this capability, particularly with a battery-powered device, has yet to be visited within the pertinent prior art.

There thus exists a distinct need to provide an effective portable canopy-based ceiling fan device for these reasons. To date, as noted above, there is a lack of fans that allow for such desirable attributes, particularly as it pertains to the ability to accord the desired circulation effects within a canopy setting without impeding individuals' movements thereunder. The present invention, then, makes up for such deficiencies.

Advantages and Summary of the Invention

An advantage of the invention is the facilitation of transport and implementation of the inventive overhead fan with an outdoor canopy/tent article. Another advantage is the ability to provide a battery-powered overhead fan in an outdoor setting. Another advantage is the ability to detach, take-down, and stow such an inventive fan on demand for further utilization at a desired location.

Accordingly, the invention encompasses a portable, battery-powered overhead fan including a plurality of fan blades that lock into place during fan operation and that unlock and turn downward for stowing purposes, said overhead fan further including connectors for temporary attachment to a frame structure. More succinctly, then, such an invention includes, in a possibly preferred embodiment a portable, possibly lightweight, overhead fan comprising a) an upper portion having a top region and a bottom region, said upper portion housing a power source, a motor powered by said power source, and a plurality of stowable connectors, wherein said connectors are attached to and extendable upward from said top region, b) a lower portion extending from the bottom region of said upper portion, said lower portion including a rotatable base operated by said motor and including a plurality of base extensions, and c) a plurality of fan blade components having outer blade portions and inner blade extensions leading from each outer blade portion toward said base extensions, wherein said plurality of fan blade components numbers the same number as said plurality of base extensions and for each inner blade extension there is a connected base extension; wherein said inner blade extensions and said base extensions are each attached through locking hinges that provide an axis of rotation for said fan blade component of at most 90 degrees when unlocked and proper fan blade configuration for operation when locked; and wherein said each of said plurality of stowable connectors includes a hook portion and a hinge portion. Also encompassed herein then is a canopy including a frame and the overhead fan described above and attached thereto. Furthermore, a method of erecting a canopy having an overhead fan attached thereto is also encompassed herein, utilizing the fan described above and in greater detail, below.

Such an overhead fan may be referred to as a ceiling fan, although, as noted throughout, this type is portable and provided as a means to impart air circulation under erected canopies and other like structures. Importantly, however, the inventive device is, initially, an all-encompassing machine to provide such air circulation results on demand. In other words, the term "power source" utilized to describe and define such a device is intended to mean one that does not require external electrical connections and/or cords. Thus, battery power, or other like possibilities, is utilized for operation and activation of such an inventive device. As long as a suitable voltage level is permitted to operate the motor present for such operation purposes, and the batteries (or other power sources) needed are provided suitable cavities for placement and connection to such a motor, such a power source would be considered acceptable. In one embodiment, then, is the provision of recessed chambers for battery placement having anode and cathode connections for electrical charge transfer. Such chambers may be configured to allow for standard D, C, and 9-volt batteries, including the potential for series of multiple batteries aligned for increased power output. The utilization of four D batteries, two in sequence within juxtaposed cavities in the upper portion of the subject fan would be potentially preferred, due, primarily, to the amount of electrical charge available from such a configuration. Additionally, however, such batteries may be provided in rechargeable fashion, such as nickel cadmium, even lithium ion, types. These batteries may thus be supplied with a charging station, or even a suitable cord for connection to a port on the fan itself that may be plugged into a suitable electronic outlet for such a purpose. This battery powered device, then, is not beholden to any external cords or outlets (except for the possible recharging capability), allowing for full portability to locations that are not provided with such electrical sources.

This portable overhead fan thus includes other "standard" ceiling fan components, including a motor (connected to the power source, understood in this situation to be, again, a battery powered source, instead of a typical permanently integrated or cord-provided source) that accords rotation capability to fan blades during operation. A switch allows activation and inactivation by a user that ostensibly allows for electrical charge to transfer from the power source for operation and discontinue such transfer to turn the device off, as well. The rotating base, as it is referred to herein, is a carousel-type component that turns in either direction in relation to the operation of the motor. The fan blades within the inventive device, however, are not structured as in typical ceiling fans, particularly in terms of the support arms that extend from the rotating (revolving) base and retain the blades at desired distances and angles for maximum effect. As alluded to above, such support arms are configured to include a locking hinge that separates the fan blade arms (extensions) from the rotating base extensions. In other words, the carousel-type base includes extending support arms that are of a certain length and that attach to the fan blades through different support arms that extend from such fan blades toward the rotating base. The locking hinge thus provides the attachment between the base extensions and the fan blade extensions. Such a hinge component provides the capability of locking the fan blade extensions (and thus the blades themselves) into a fully extended configuration that aligns the blades to the desired disposed angle (and length, for that matter) for maximum air circulation effect (as for the permanently configured ceiling fan blades of typical devices). When not in operation, the ability to unlock such a hinge component for each fan blade component thus permits a user to fold the blades downward, while still resiliently attached to the rotating base (and thus the overall overhead fan itself). In this manner, a user may then stow the folded overhead fan into a carrying case of suitable shape (such as a rectangular box, for instance) with the fan blades turned from fully extended disposition to compacted substantially perpendicular arrangement. The resultant shape of the stowable overhead fan would thus be of the upper portion (which is generally, though not necessarily, circular in shape itself) as the widest part thereof, allowing for a storage/transport container that exhibits a suitable shape for placement with either the folded blades or the upper portion first placed therein. In any event, with the resilient attachment through the locking hinge (or like structure) provided between the rotating base extensions and the fan blade extensions, this stowable feature is permitted, facilitating, again, the portability of the overall device to different locations as desired, as well as the ability to provide a protective case for storage and transport.

Such portability is further enhanced through the inclusion of suitable stowable connectors on top of the upper portion of the inventive overhead fan. Such components provide reliable temporary attachment to frame structures (such as canopy "skeletons" and the like) to permit enjoyment of the air circulation benefits thereof. In other words, without the inclusion of such stowable connectors, the ability to actually place such an overhead fan onto a canopy frame (or other like structure) would be impossible, particularly in terms of providing an all-encompassing (e.g., battery-powered) device. As noted above, typical ceiling fans are actually incorporated into a building structure, attached not only through attachments within a ceiling, but also to electrical lines embedded within such a building structure. Outdoor canopies, which are, again, typically erected and taken down on demand and at any number of different locations, do not provide such potential permanency to the user. Canopy frames are provided, themselves, in stowable fashion, generally of metal or plastic structures that unfold (in, for instance, accordion fashion) to allow for corner posts to take on the full weight of such a structure that rises to an apex elevation in the middle. Fans cannot be permanently attached to such structures, as would be evident to the ordinarily skilled artisan, particularly if disposed near the apex thereof. Thus, the user would be forced to at least begin construction of the canopy frame, then attach the inventive overhead fan, and continue and finish erection thereof. The canopy cover may, in such a situation, be attached after the frame is finished or prior to completion. The ability to then attach an overhead fan prior to either full construction of the frame alone or full completion of the frame and cover, has not been undertaken in the past. The stowable connectors within the bounds of the invention overhead fan, coupled with the potential for a lighter weight fan (in comparison with typical ceiling fans, for example), at least to a certain extent, allows for facilitation of actual canopy construction with a fan already attached prior to completion. In particular, as is potentially preferred, at least, the utilization of stowable hook implements (of any shape, whether rounded, squared, or the like) as the connectors allows for reliable placement over arms of a canopy frame, particularly near the apex (middle) thereof. In such a situation, basically, when all such connectors are placed over the frame arms (which should be of the same number and disposition, at least in complementary fashion, to the connectors themselves, for instance, with four connectors, the frame would have four arms, both the connectors and arms being disposed 90 degrees from one another) would exhibit even pressure to all frame arms. This arrangement then accords uniform distribution of force to all frame arms, thus preventing the overhead fan from "slipping" or skewing its position on the actual frame, both during construction and utilization. This stowable connector format further allows for stability of the subject fan when attached in such a fashion to such a frame and when activated. Certainly, when operated, the torque applied by such revolving fan blades may cause undesirable movement as situated, causing uncertainty and suspect movement and, for that matter, sounds (squeaking, for instance, due to metal on metal scraping). Thus, the stowable connectors, particularly when supplied in hook (or more precisely, squared hook) structures, securely and resiliently attach to such a frame to avoid unwanted movements of this nature. Additionally, the stowable connectors, when provided in such a hook fashion, and particularly in terms of being provided in a manner that allows a user to manipulate such connectors around an axis (such as a button hinge, for example, embedded within the upper portion of the subject fan) can be placed individually over such canopy frame arms or simultaneously, if desired. This axis configuration for the connectors also comports the stowable property thereto as the connectors are ostensibly extended perpendicularly from the upper fan portion during utilization and can be maneuvered to be on and parallel such an upper fan portion surface (with a clip, for instance, to retain such connectors on such a surface during stowage).

Additionally, the subject overhead fans are supplied with at least one other stowable connector that provides a raised loop at the center of the top of the fan itself. Such an extra connector allows for application to a canopy or tent that does not include a suitable frame (particularly with centered arms near the apex), or in any other location other than under a canopy or tent (such as within a workshop, room, porch, and the like), on demand. In such a situation, the apex of such a canopy or frame may be supplied with a lowered, secured hook (or like implement) to allow for the centered connector raised loop to be placed there over to allow the fan to be placed in the desired location under such a structure. As well, such a centered "extra" stowable connector allows for the introduction of such a subject fan in different areas underneath such a canopy or tent, if desired, thus permitting the utilization, if desired, of more than one fan in different area thereunder, too. When utilized, the subject fan may be further stabilized by attaching resilient cords or poles connected to canopy or tent frame members and the top of the subject fan, simultaneously, if desired. Such an "extra" connector loop may further be utilized by a user as a means to lift and/or carry the subject fan as needed, as well.

The overall weight of the subject fan, as alluded to above, may be lighter as compared with standard ceiling fans. To accomplish this, such a fan may be manufactured from primarily plastic components, and the motor integrated therein may provide blade revolving speeds that do not require an excessive rate (with air circulation the main goal). In this manner, if desired, the motor itself would not require typical machinery to permit high speed blade turning results, thus allowing for smaller and lighter internal parts, leading to the overall ability to reduce the weight of the fan itself.

Once in place and erected with the subject canopy/tent, the fan may then be operated through activation of a switch, either directly on the fan itself, through an extended pull switch, or even through a remote assembly, if desired. Such switch configurations, etc., are well known in the art, certainly.

The inventive overhead fan may include a number of other components that accord certain benefits to the user. As one example, a fluid reservoir and atomizer (or spraying device of some design) may be included and incorporated within the overall structure. The user could then introduce water within the reservoir (or, for that matter, attach a hose from a water source, potentially) that is then dispersed therefrom via the atomizer or sprayer (through the connection with, for instance, the power source and/or motor of the fan) to accord atomized liquids for enhanced comfort to the user and other individuals under the canopy and/or tent. In high temperature and/or humidity environments, such an accessory would be highly practical and desirable. Such a reservoir may be provided to the upper portion of the fan device or even provided peripherally around such a device. The atomizer/sprayer may be configured on the underside of the fan device (such as on or within a plate that covers the rotating base, or even the underside of the upper portion of the fan with apertures provided at intervals around the lower periphery) or in any other fashion. Additionally, the inventive overhead fan may include a light on the underside thereof, such as integrated within, embedded within, or extending from a plate covering the rotating base on the underside of the lower portion of the fan. Such a light may be integrated, as well, with the power source of the fan, thereby allowing for activation either in concert with the fan or separately through a different switch.

In terms of materials for the component parts of the inventive overhead, the blades may be manufactured from wood, wood composite, plastic, fiberglass, metal, paper, and any combinations thereof. The housings may be made of metal or plastic, as well. Plastic would accord lighter weight potentially. The locking hinges are preferably made from metal (steel, aluminum, brass, as examples), as well as the rotating base extensions and the fan blade extensions. Such is preferable since the forces applied thereto during actual operation may be significant enough that the hysteresis potential of plastic components may result in undesirable (and relatively quick) failure of the components. Although plastic components may still be utilized, unless such is provided as, for instance polyaramids or like synthetic structures (heavy plastics, for instance), metal components are, again, potentially preferred for such structures. Likewise, the stowable connector components are preferably of metal construction, particularly since forces applied during utilization and operation may be sufficiently high that metal materials would be preferable. Again, however, synthetic (plastic) components may be utilized for such a purpose, if desired. The motor assembly is of typical construction, well known to the ordinary artisan within the ceiling fan art.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The advantages of the disclosure, along with the various features of novelty which characterize the disclosure, are pointed out with particularity in the claims annexed to and forming a part of this invention disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE DRAWINGS AND PREFERRED EMBODIMENTS

With reference now to the drawings, and in particular to FIGS. 1 through 6 thereof, a new portable, stowable overhead fan embodying the principles and concepts of the invention, without any limitation of breadth of the overall invention intended.

Figure 1:
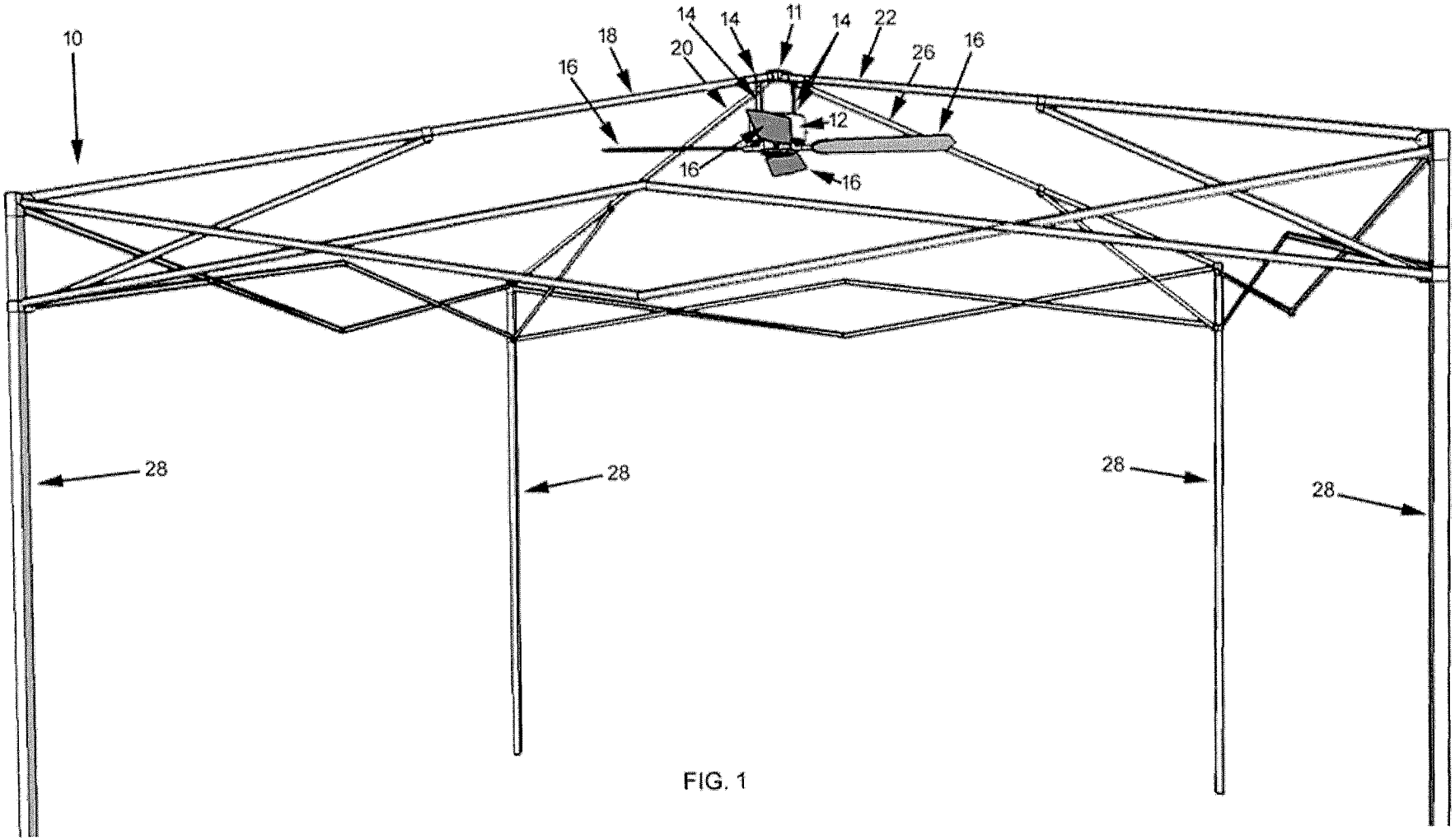
FIG. 1 is a side perspective view of one potentially preferred embodiment of a canopy frame to which an inventive overhead fan has been attached.

FIG. 1 presents a side perspective view of one potentially preferred configuration of an inventive overhead fan/canopy frame configuration 10. The configuration 10 includes a canopy having four legs 28 and four rising arms 18, 20, 22, 26 with a middle apex 11. Temporarily attached is the overhead fan with fan blades 16, a motor/power source housing 12, and four connectors 14 placed over the canopy frame arms 18, 20, 22, 26 near the middle apex 11. With a cover (not illustrated) placed over the canopy frame, a complete unit with shade and air circulation capability, particularly from a battery-powered fan that is ostensibly hanging from the frame itself (and thus is removable on demand) is provided for a user.

Figure 2:
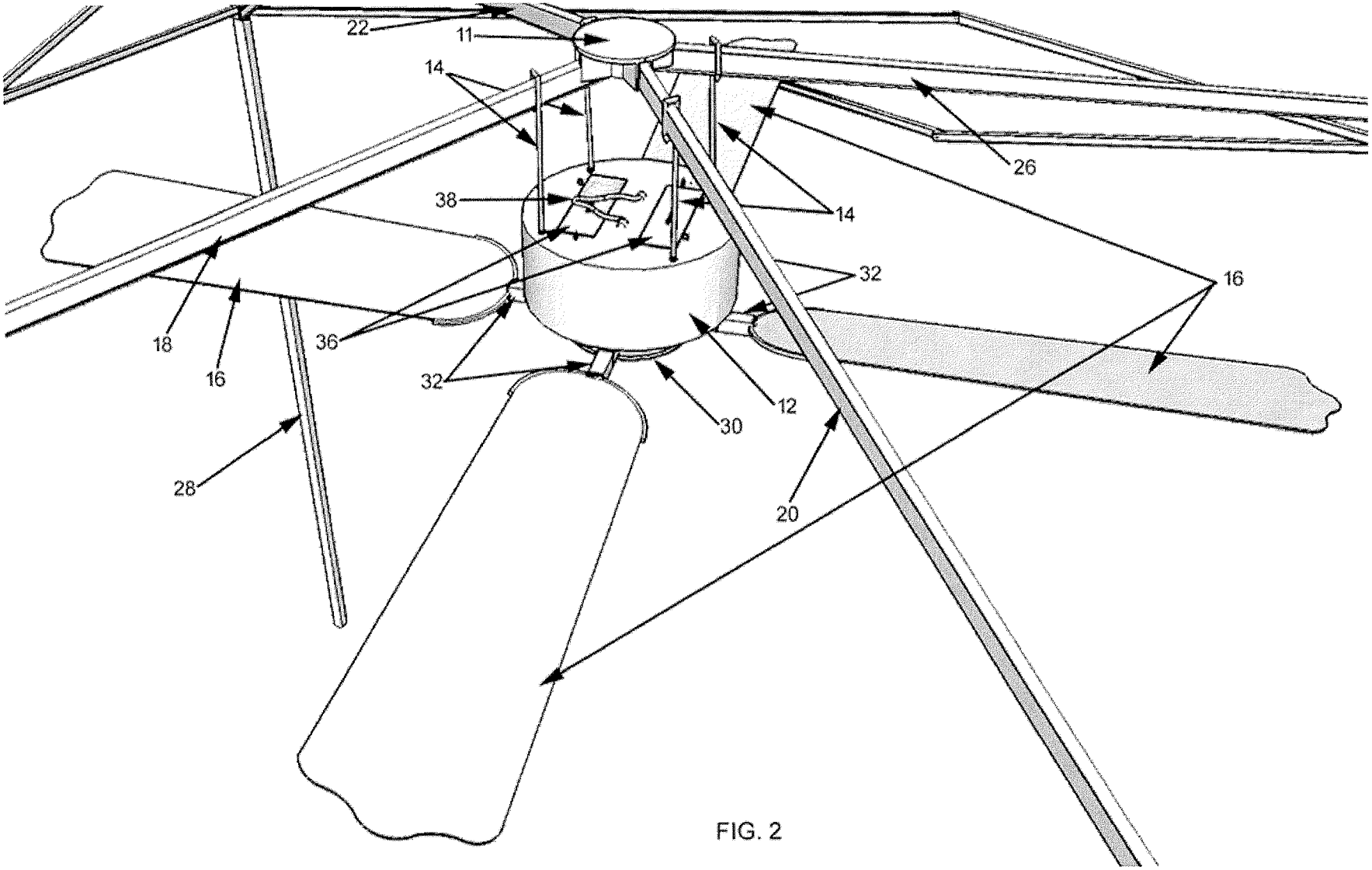
FIG. 2 is a top perspective view of the canopy frame and inventive overhead fan as shown in FIG. 1.

FIG. 2 shows the fan/canopy frame configuration 10 from a top perspective view. The middle apex 11 provides a center from which the frame arms 18, 20, 22, 26 radiate to the legs 28. The fan connectors 14 are, again, placed over the arms 18, 20, 22, 26 near the middle apex 11 to provide uniform and even pressure to the canopy frame itself in this general area. As such, the fan is reliably placed and attached to the canopy frame and thus is properly supported during utilization thereof. From this perspective, as well, it is easily seen the motor/power source housing 12, and its top surface including compartments for batteries 36, an "extra" stowable connector loop 38 (for a user to utilize if the four stowable connectors 14 do not complement the canopy or tent frame, or placement in a different location other than the apex thereof is desired, as well as to carry the overall subject fan if needed), as well as the stowable connectors 14. As well, the fan blades 16 are shown to be attached to fan blade extensions 32 (basically blade support arms) that lead to a rotating base (platform) 30.

Figure 3:
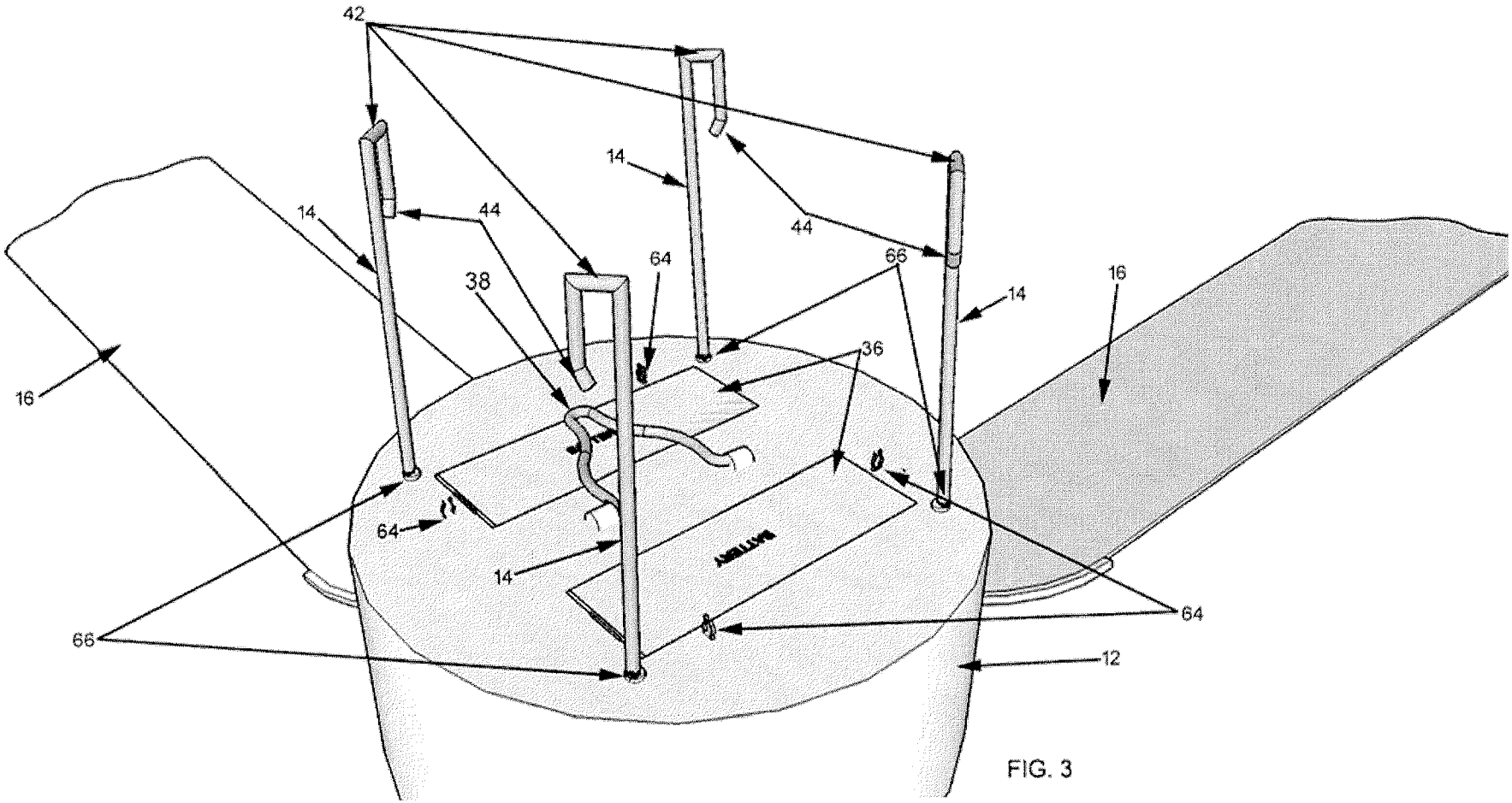
FIG. 3 is a top perspective view of one potentially preferred embodiment of an inventive overhead fan in unstowed ready-to-attach configuration.
Figure 4:
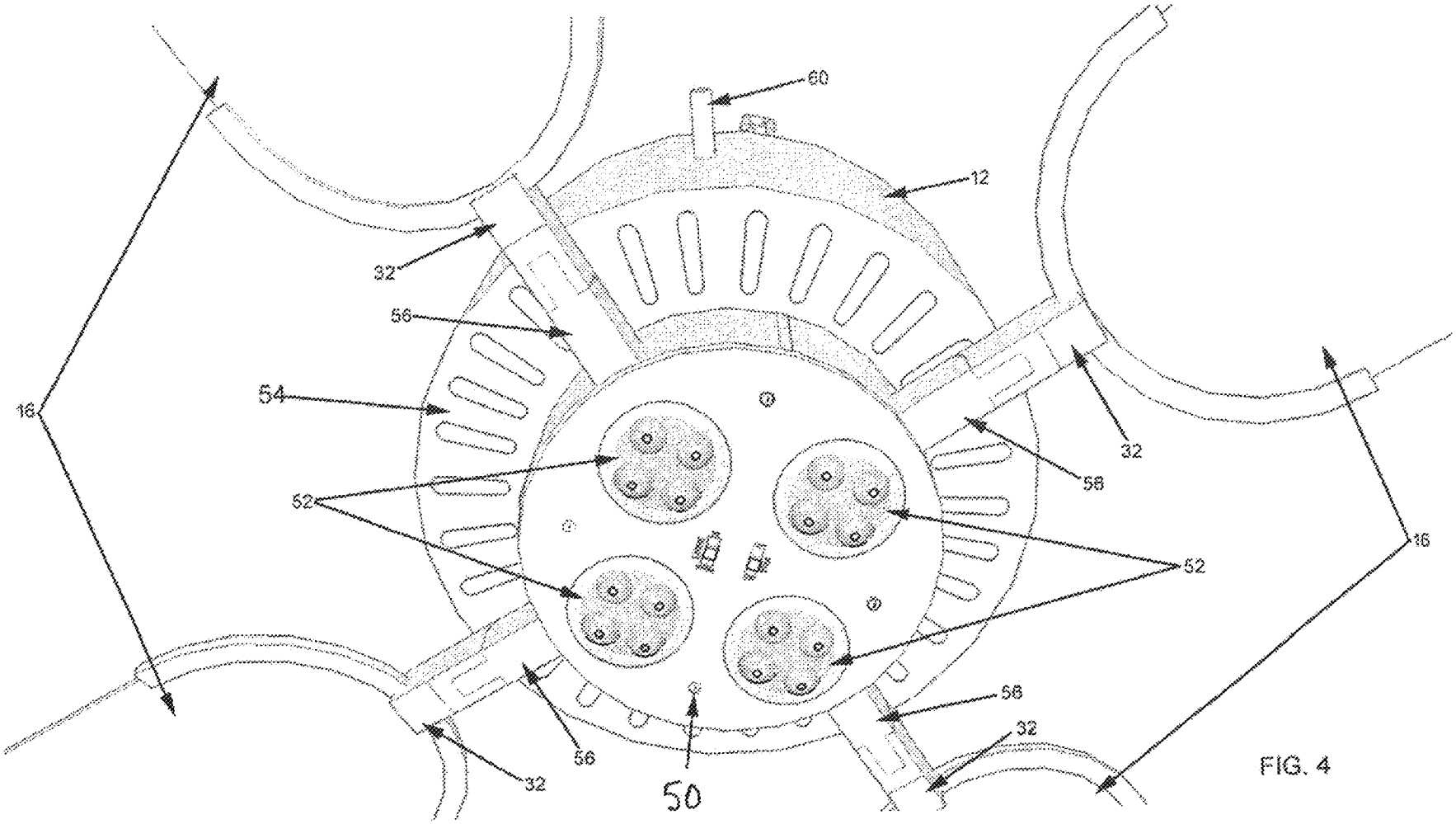
FIG. 4 is a bottom perspective view of the overhead fan of FIG. 3.
Figure 5:
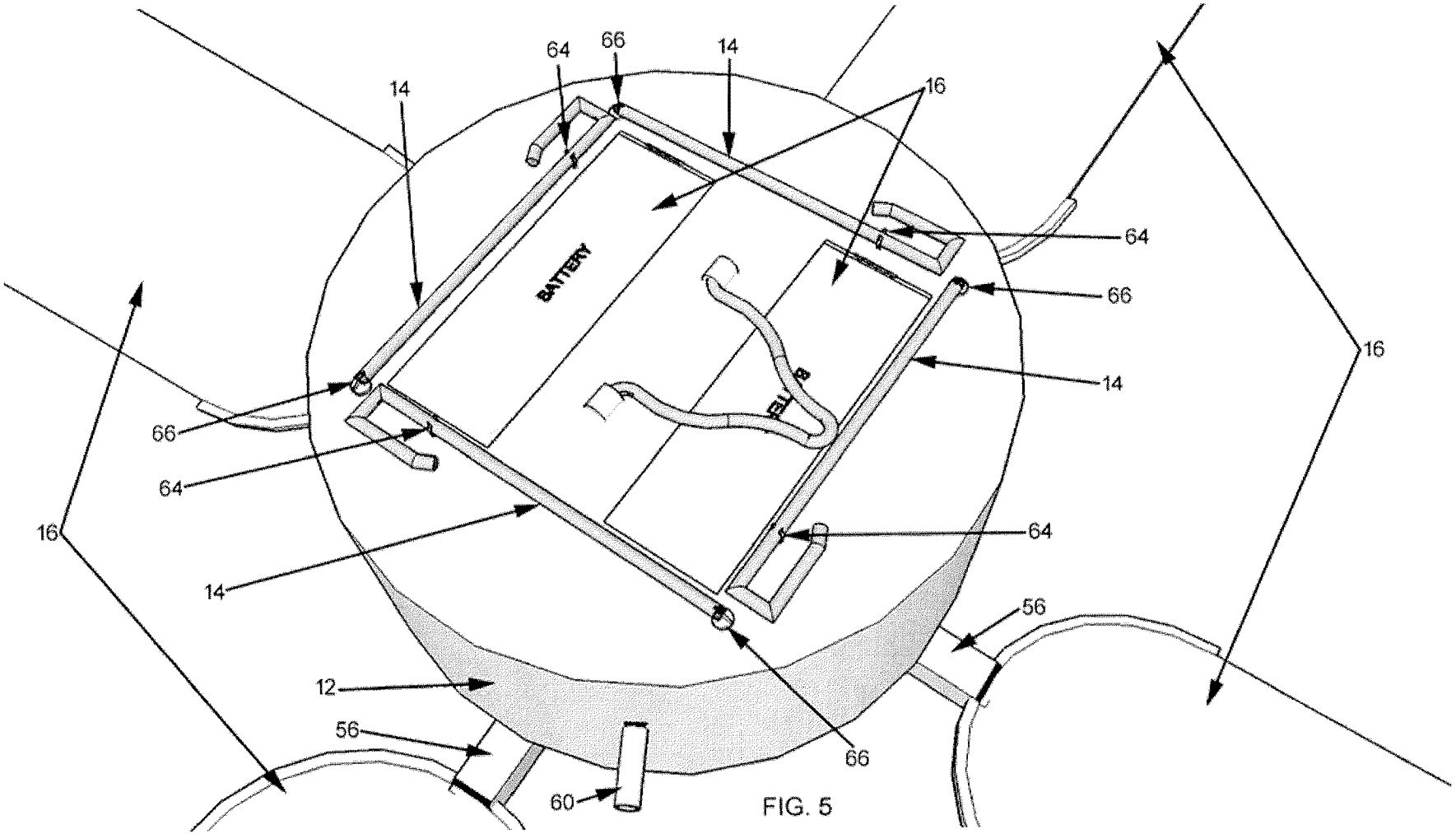
FIG. 5 is a top perspective view of the inventive overhead fan of FIG. 3 with canopy attachments in stowed configuration.

FIG. 3 shows a closer view of the upper portion (motor/power source housing 12) of the overhead fan of FIG. 2. The battery compartments 36 are shown with the "extra" stowable connector 38, in closer detail. Shown in extended fashion and not placed over frame arms are the stowable connectors 14, each having a button hinge 66, a stowing clip 64, an upper hook edge 42, and a lower hook end 44, allowing for reliable placement over an arm (18, 20, 22, 26, of FIG. 2) and, upon stowing, proper alignment for each such connector hook to fold onto the housing 12 and clipped securely thereto. FIG. 5 provides such a stowed view of the connectors 14, as this is also a top perspective view of the fan. Also noticeable in FIG. 5 are the rotating base extensions 56 that lead to the fan blade extensions (32 of FIG. 2). FIG. 4 provides a bottom perspective view of the fan with the fan blades 16 attached to fan blade extensions 32 that are attached to the rotating base extensions 56 through locking hinges. The rotating base extensions 56 lead to a rotating base (30 of FIG. 2) that is covered by a plate 50. The plate 50 includes switches and spraying apertures 52 for liquid atomizing under the fan itself. The housing 12 includes a screen 54 on its underside to allow for heat dissipation from the motor (not illustrated), as well as a switch 60 for activation of the device.

Figure 6:
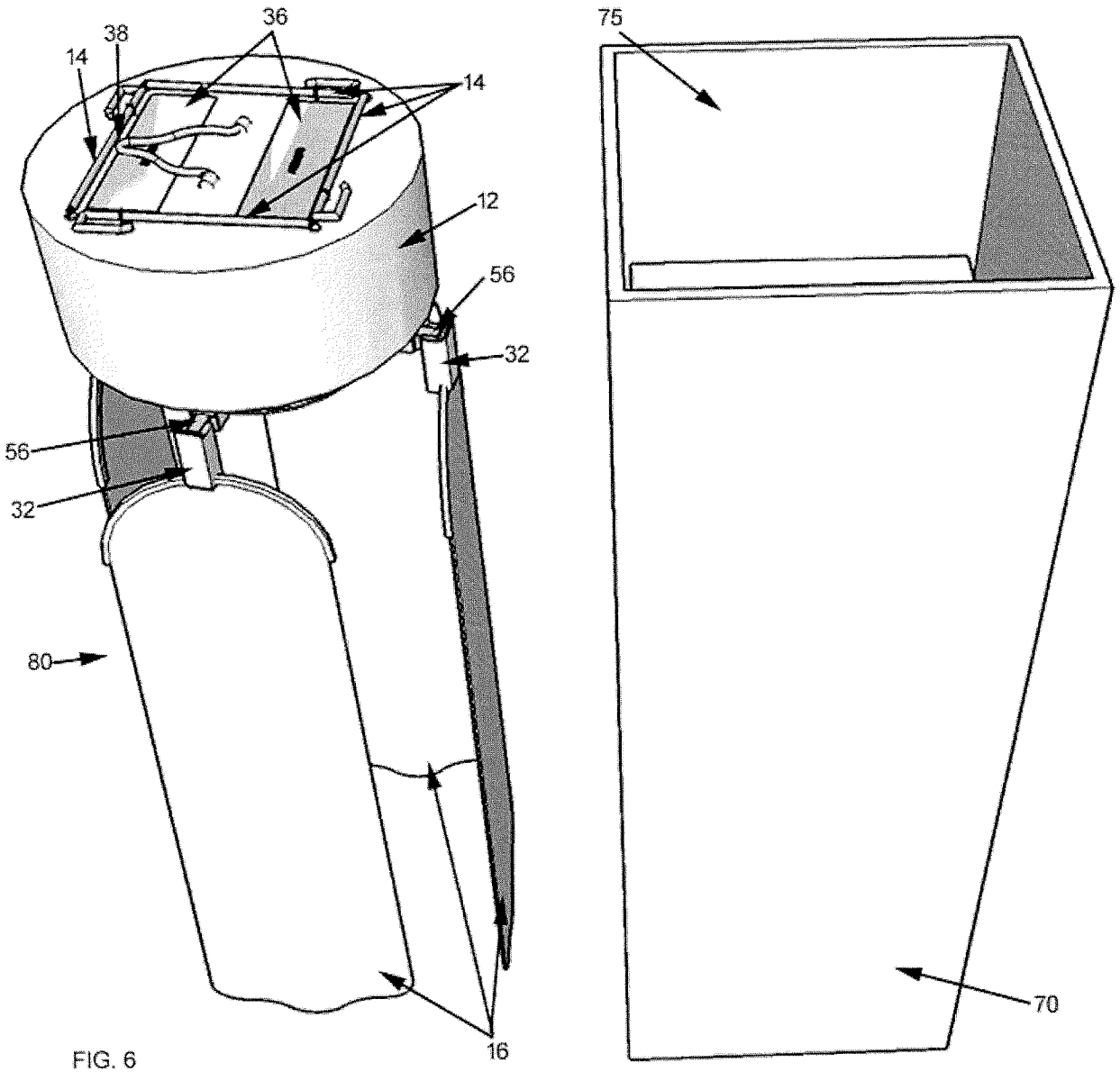
FIG. 6 is a side perspective view of the inventive overhead fan of FIG. 3 in stowed fashion in tandem with a carrying case.

The locking hinges allow for the fan blades 16 to be manipulated from full operation extension to stowage status. FIG. 6 shows the fan in its stowage status with the fan blades 16 folded downward after unlocking of the hinges and rotating of the fan blade extensions 32 perpendicularly (roughly, at least) from the rotating base extensions 56. The connectors 14 are likewise stowed as in FIG. 5, thus providing the most compact structure (with the housing 12 being the widest part thereof). Also provided is a carrying case 70 with a cavity 75 into which the fan may be placed for stowage and transport as desired.

Thus, a user may then remove such a stowed fan from the case 70, either keep the blades 16 folded downward, or open them up to full extension, unstow the connectors 14 from the housing 12 and place them over the frame arms 18, 20, 22, 26 of a canopy frame and have a completed canopy/fan article for full shade and air circulation (as well as possible liquid spraying) for a comfortable outdoor canopy location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A portable, completely battery-powered overhead fan having a top surface and including a plurality of fan blades that lock into place during fan operation and that unlock and turn downward for stowing purposes, wherein said fan blades are disposed for rotation in a horizontal position during fan operation, said overhead fan further including four separate connectors for temporary and removable attachment through placement over frame arms of a canopy frame structure, wherein said frame arms of said canopy frame structure are four in number, are disposed 90 degrees from another, and rise linearly to an apex, wherein each of said four separate connectors is disposed 90 degrees from one other and includes a hook structure with an upper hook edge for placement over said frame arms of said canopy and a lower hook end that attaches to said top surface of said overhead fan through a hinge, wherein said four separate connectors stow on said overhead fan top surface when not in use, wherein said four separate connectors place over said frame arms of said canopy in directions that are different from one another and apply uniform and even pressure to said canopy frame, wherein said upper hook edges of circumferentially adjacent separate connectors are disposed in directions 90 degrees from each other when in place over said frame arms of said canopy, and wherein said fan does not include any external electrical connections and/or cords.

2. A canopy including a frame and configured to slope linearly to an apex, said frame including four arms extending from an external point to said apex, wherein said overhead fan of claim 1 has been attached through placement of said upper hook edges of said four separate connectors over said arms of said frame, wherein each separate connector is hooked over a separate frame arm, and wherein said four separate connectors are attached adjacent to said frame apex.

3. A method of providing air circulation under a canopy having a frame and a cover placed there over, said method including the steps of a) providing said frame of said canopy, said frame comprising four arms leading from external points of said canopy to a central apex, wherein said apex is the highest point thereof, and wherein said arms extend linearly from said external points to said apex, b) placing said upper hook edges of said four separate connectors of said overhead fan of claim 1 over each separate arm of said frame, c) erecting said canopy to its full configuration, d) placing said cover over said canopy, and e) activating said fan through operation of a battery power source.

4. A portable, completely battery-powered overhead fan having a top surface and including a plurality of fan blades disposed for rotation in a horizontal position during fan operation, said overhead fan further including four separate connectors for temporary and removable attachment through placement over frame arms of a canopy frame structure, wherein said frame arms of said canopy frame structure are four in number, are disposed 90 degrees from another, and rise linearly to an apex, wherein each of said four separate connectors is disposed 90 degrees from one other and wherein each of said four separate connectors includes a hook structure with an upper hook edge for placement over said frame arms of said canopy and a lower hook end that attaches to said top surface of said overhead fan through a hinge, wherein said four separate connectors stow on said overhead fan top surface when not in use, wherein said four separate connectors place over said frame arms of said canopy in directions that are different from one another and apply uniform and even pressure to said canopy frame, wherein said upper hook edges of said circumferentially adjacent separate connectors are disposed in directions 90 degrees from each other when in place over said frame arms of said canopy, and wherein said fan does not include any external electrical connections and/or cords.

5. A canopy including a frame and configured to slope linearly to an apex, said frame including four arms extending from an external point to said apex, wherein said overhead fan of claim 4 has been attached through placement of said upper hook edges of said four separate connectors over said arms of said frame, wherein each separate connector is hooked over a separate frame arm, and wherein said four separate connectors are attached adjacent to said frame apex.

6. A method of providing air circulation under a canopy having a frame and a cover placed there over, said method including the steps of a) providing said frame of said canopy, said frame comprising four arms leading from external points of said canopy to a central apex, wherein said apex is the highest point thereof, and wherein said arms extend linearly from said external points to said apex, b) placing said upper hook edges of said four separate connectors of said overhead fan of claim 4 over each separate arm of said frame, c) erecting said canopy to its full configuration, d) placing said cover over said canopy, and e) activating said fan through operation of a battery power source.

* * * * *